US007766400B2

(12) United States Patent
Predebon

(10) Patent No.: US 7,766,400 B2
(45) Date of Patent: Aug. 3, 2010

(54) DOOR STAY

(76) Inventor: Dyna Kellie Predebon, C/ Terry Hurlock & Associates 15 Patrick Street, Aitkenvale, Queensland (AU) 4814

( * ) Notice: Subject to any disclaimer, the term of this patent is extended or adjusted under 35 U.S.C. 154(b) by 0 days.

(21) Appl. No.: 10/590,315

(22) PCT Filed: Mar. 3, 2005

(86) PCT No.: PCT/AU2005/000309

§ 371 (c)(1),
(2), (4) Date: Aug. 23, 2006

(87) PCT Pub. No.: WO2005/085569

PCT Pub. Date: Sep. 15, 2005

(65) Prior Publication Data

US 2007/0200364 A1 Aug. 30, 2007

(30) Foreign Application Priority Data

Mar. 3, 2004 (AU) ..... 2004200846

(51) Int. Cl.
*E05C 19/18* (2006.01)
*E05F 5/02* (2006.01)

(52) U.S. Cl. ..... 292/288; 292/289; 292/348; 292/DIG. 15; 16/82

(58) Field of Classification Search ..... 292/288, 292/289, 348, DIG. 15; 16/82
See application file for complete search history.

(56) References Cited

U.S. PATENT DOCUMENTS

| | | | | | |
|---|---|---|---|---|---|
| 848,644 | A * | 4/1907 | Flegel | 292/288 |
| 1,197,769 | A * | 9/1916 | Shane | 16/86 A |
| 1,336,527 | A * | 4/1920 | Lewis et al. | 16/86 A |
| 1,520,199 | A * | 12/1924 | Morgan | 16/86 A |
| 3,451,708 | A * | 6/1969 | Brooks | 292/264 |
| 3,620,483 | A | 11/1971 | Weinberger | |
| 4,811,454 | A * | 3/1989 | Crook et al. | 16/82 |
| 5,004,279 | A * | 4/1991 | Radcliff | 292/288 |
| 5,288,257 | A * | 2/1994 | Zacherl | 446/72 |
| 5,291,631 | A | 3/1994 | Schjoneman | |
| 5,297,692 | A * | 3/1994 | Kronmiller | 220/318 |
| 5,501,494 | A * | 3/1996 | Willetts | 292/262 |
| 5,794,871 | A * | 8/1998 | Willetts | 292/288 |
| 5,873,146 | A * | 2/1999 | Mungo et al. | 16/82 |
| 2003/0132639 | A1 * | 7/2003 | Franklin | 292/288 |
| 2007/0085352 | A1 * | 4/2007 | Ulanday et al. | 292/288 |

FOREIGN PATENT DOCUMENTS

| | | | |
|---|---|---|---|
| GB | 1211115 | | 11/1970 |
| GB | 2177156 | | 1/1987 |
| GB | 2224949 | * | 5/1990 |
| JP | 02008480 | * | 2/1990 |
| WO | WO 91/05127 | | 4/1991 |
| WO | WO 00/47856 | | 8/2000 |

* cited by examiner

*Primary Examiner*—Carlos Lugo
(74) *Attorney, Agent, or Firm*—Hoffman, Wasson & Gitler, P.C.

(57) ABSTRACT

A door stay having a first part adapted to be supported by door handle on one side of the door, a second part adapted to be supported by the door handle on the other side of the door, and an intermediate part that is adapted to extend over the edge of the door to prevent the latch tongue from engaging with the keeper.

3 Claims, 5 Drawing Sheets

DOOR STAY

FIELD OF THE INVENTION

This invention is directed to a door stay and particularly to a stay that can be attached to a door to prevent the door from being latched or locked and also accidentally closed. The device is typically attached to the door handle and can form the appearance of toy animals. The device finds particular use in children's bedrooms where there is an advantage in having the door slightly ajar but not able to accidentally latch closed. The device may also be used by elderly people, or people suffering from arthritic conditions by keeping the door slightly open and therefore obviating the need for these people to manipulate the door handle.

BACKGROUND ART

When putting children to sleep in a bedroom, many mothers wish to have the bedroom door slightly ajar to enable them to hear any unusual sounds. Also, children often find sleeping easier if they can also hear some noise. It is found that keeping the door slightly open provides a good balance between a reduction of noise and like in the child's bedroom while still allowing the mother to hear any unusual sounds.

A simple way is to simply leave the door slightly open. However, it is found that gusts of wind can cause the door to suddenly slam closed. This can cause distress to the baby and requires the door to be repeatedly re-opened.

It is well known to use small wooden or plastic wedges that are wedged underneath the door to keep the door in a slightly open position. However, a disadvantage with a wedge is that it prevents the door from being opened further should the child wish to go to the toilet or should the mother wish to suddenly open the door possibly in a panic situation. Also, the gap between the bottom of the door and the floor/carpet is sometimes too small for positioning of a wedge.

It is also well-known to use a rolled up towel, a cushion, or other type of item which is positioned on the floor and between the door and the door jamb again to keep the door in a slightly open position. However, these devices can comprise a tripping hazard.

A disadvantage with all the above-mentioned devices is that they do not prevent the door latch from engaging with the striker or keeper on the door jamb in the event that the wedge/towel etc. is inadvertently removed. Again, this can cause the door to suddenly close causing the baby to cry.

Small children are often easily frightened in darkened rooms. However, children can be often comforted by a familiar object in the room such as a teddy bear or other stuffed toy. As the child will often look at the small crack of light in the slightly open door, there would be an advantage if a familiar object could be placed here to comfort the child.

It is known to provide a door stopper that comprises a plastic member that sits over the upper horizontal edge of the door and prevents the door from closing. One disadvantage with this stopper is that the upper edge of the door is quite high and it can be quite inconvenient to attach the door stopper or remove the door stopper when not required.

It is known to provide a door latch to prevent the door from slamming. However, this latch needs to be fastened to the door or to the door jamb and this can result in unsightly holes if the latch is no longer required. Also, many consumers are reluctant to attach any type of device that requires holes to be drilled into the door or the door jamb and the like. Another disadvantage with this particular latch is that is not portable, and once in place, it is not possible to use it on another door.

It is also known to provide a cushion member provided with a slot type recess that press fits against the edge of the door. The member can be pushed against the door edge and held in place. However, it is found that the cushion member can be quite easily dislodged especially if the door swings to the closed position a few times.

This is because the member is held only by the cushioning resilient effect and not by any positive type engagement. Also, the cushion member can deteriorate over time to cause it to fall of the door edge. Another disadvantage with this product is that it is either attached to the door and in the "use" position or entirely removed from the door. However, it is not possible to have the cushion member attached to the door while being inoperative in use. Thus, the cushion member does not have the versatility that enables it to remain attached to the door but easily converted from the "nonuse" position to the "use" position.

This disadvantage is also apparent with wedges and the like. If the wedge is removed away from the door, it can be misplaced or lost. However, if it is placed close to the door, it can be a tripping hazard or be generally in the way.

In Australia, it is found that crushing or trapping injuries are within the top 10 causes of injuries for children under five years of age. Indeed, over 1000 children per year are injured from crushing or trapping injuries, most commonly fingers that are trapped or jammed in doors.

Therefore, there would be an advantage if it were possible to provide a device that would keep the door slightly open and which would be more effective in preventing the door from closing, and which can also, if desired, remain attached to the door but in an inoperative condition and that it can be quickly repositioned to a "use" condition.

In the event of a panic situation such as a house fire, there is an advantage to ensure that the door to a child's bedroom is not lock or latched as under panic conditions, even a latched door can be difficult to open.

Some doors (and especially sliding doors) are provided with a self-closing mechanism which means that when the door is closed, it will automatically latch or lock. Thus, there would be an advantage if a door stay could be provided that would prevent this from occurring inadvertently.

There is also a need to provide some form of door stay for elderly people, or people with arthritic conditions, or people that would otherwise find it difficult to manipulate a door handle. There is an advantage if the door stay could remain attached to the handle even in the inoperative condition such that when required, it can be quite easily converted to the operative or "use" position without unnecessary bending, lifting, finding etc.

It will be clearly understood that, if a prior art publication is referred to herein, this reference does not constitute an admission that the publication forms part of the common general knowledge in the art in Australia or in any other country.

OBJECT OF THE INVENTION

It is an object of the invention to provide a door stay that may at least partially overcome the above-mentioned disadvantages or provide a useful or commercial choice.

In one form, the invention resides in a door stay, the door stay having a first part adapted to be supported by door handle on one side of the door, a second part adapted to be supported by the door handle on the other side of the door, and an intermediate part that is adapted to extend over the edge of the door typically to prevent the latch tongue from engaging with the keeper.

The door stay will typically be used with a door of the type that has a latch tongue extending from a lock in the door and which engages with a keeper on the door jamb. In this configuration, the door stay can function to prevent the latch tongue from engaging with the keeper. However, it is envisaged that the door stay may also be used on doors that are provided with handles but that do not have a latch tongue, or similar type of member to hold the door in the latched or the lock position. It should also be appreciated that the term "latch tongue" should be interpreted broadly and may include a latch tongue, a lock tongue, a reciprocating latch tongue or lock tongue, a rotating latch tongue or lock tongue, a plurality of latch tongues or lock tongues and the like. To explain, some security doors are now provided with a pair of spaced apart oppositely rotating hook tongues. While such doors are not commonly found as bedroom doors, there may be situations where the door stay which forms part of the present invention will find a use with such doors.

It should also be appreciated that the door stay may be used on windows. While it is not expected that the door stay will find great use on windows, there may be some windows that freely pivot between an open position and a closed position, and where there is an advantage in preventing the window from slamming shut. However, it is expected that in most instances, the door stay will be used on an internal pivoting door of conventional design and containing a latch tongue.

Thus, the door stay, rather than being placed on the ground, is now attached to each door handle and extends about the edge of the door and prevents the latch tongue from engaging into the keeper or striker on the door jamb. The door stay also prevents the door from being entirely closed, and does not have any parts on the floor that form a tripping hazard etc.

The door stay also has a positive attachment mechanism as opposed to a mere clamping action, and is therefore much more reliable.

The first part and the second part may engage directly to, or about each door handle. Various ways are envisaged by which this can be achieved. In one form, the first part may comprise a loop which may extend about the door handle. In another form, the first part may comprise a string or ribbon or other type of line member that can be attached to the door. In yet another form, the first part and the second part may be joined together and attached to each door handle. Other forms of attachment are also envisaged. For instance, each door handle may be provided with a Velcro portion which attaches to a corresponding Velcro portion of the first part and the second part. Clamps can also be used.

It is preferred however that the door handles are not modified and that the door stay is adapted to be supported by at least one and preferably both door handles.

The door handles may comprise rotating knobs, lever handles and the like. The term "door handles" can include the mechanism that attaches the door handle to the door or the lock. The mechanism may comprise the spindle, or any other type of member that may form part of a lock, a handle and the like. Therefore, it is not considered that the term "door handles" should be restricted only to the portion of the door that is gripped by the person's hand. Also, it is not considered that any particular limitation needs to be placed on the type of door handle, the size of the door handle, the manufacture of the door handle, and the like.

The door may comprise an internal door and will typically be the child's bedroom door, but no particular limitation is meant thereby and the door may comprise a toilet door, a bathroom door, any other type of internal and external door, and any other type of pivoting window or door. It is envisaged that the stay may also be used on a sliding door to prevent the sliding door from latching shut.

It is preferred that the door stay is manufactured to look like a child's toy. For instance, the door stay may be manufactured in the form of a stuffed animal such as a teddy bear, or any other type of animal. Thus, a child looking at the door will see a familiar stuffed animal. Another advantage of manufacturing the door stay in this manner is that the arms of the stuffed animal can comprise the first part and the second part of the door stay and the body of the stuffed animal can comprise the intermediate part. Of course, no particular limitation is meant by using a stuffed animal as a preferred type of door stay.

The first part and the second part should be long enough to enable them to be attached directly or indirectly or otherwise supported by the door handle. As a door handle is usually about 20 centimeters or less distant from the edge of the door, the first part and the second part will also have a typical length of between 5-20 centimeters and typically a length such that the end of the first part and the second part will be proximal to the door handle.

The intermediate portion should be sufficiently large to prevent or reduce the possibility of the latch tongue engaging into the door jamb striker or keeper. It is also preferred that the intermediate portion is cushioned to prevent any injury should a person or child walk into or past the door stay (it being appreciated that for a small child, the door stay may be at head height).

Another advantage of the door stay is that one of the parts can be removed and the other part can remain attached. This can allow the door stay to simply "hang" from one door handle but be in an inoperative condition. However, the door stay is not on the ground (which can result in a tripping hazard or be generally inconvenient, can collect dust and the like), and if the door stay is in the form of a stuffed toy, it can be hung from the inside door handle to give comfort to the child.

BRIEF DESCRIPTION OF THE DRAWINGS

Embodiments of the invention will be described with reference to the following drawings in which.

BEST MODE

Referring to the illustrations, FIGS. 1-4A illustrate a first version of the invention, while the remaining figures illustrate variations principally by which the door stay is attached to the door handles.

Figure 4:
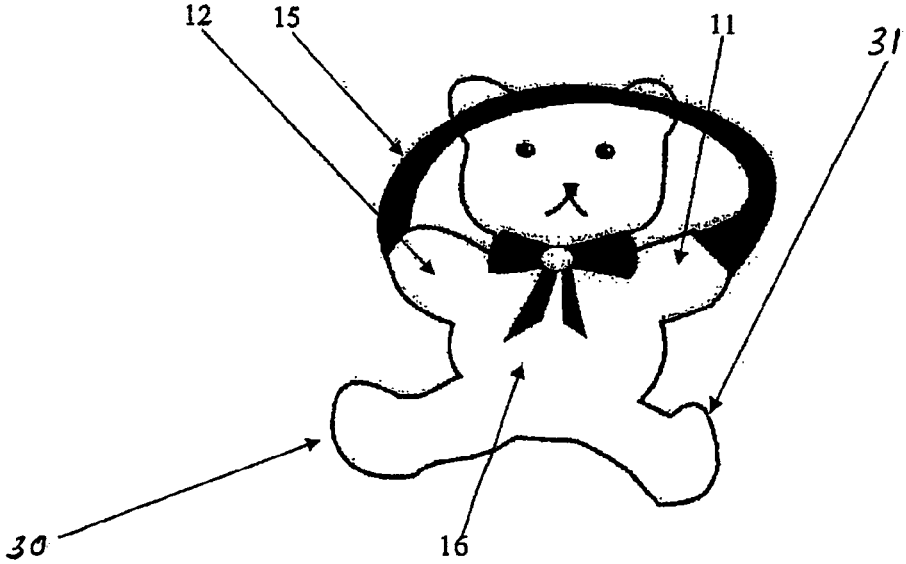
FIG. 4. Illustrates a door stay where the first part and the second part are attached together to form a loop.
Figure 4A:
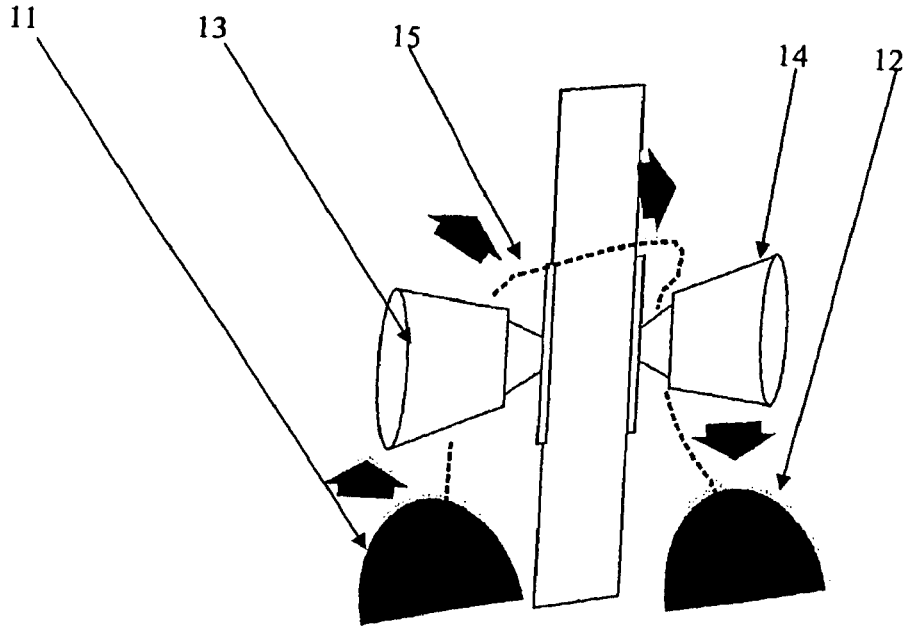
FIG. 4A. Illustrates an attachment method for attaching the door stay of FIG. 4.

Referring initially to FIGS. 1-4A, there is illustrated a door stay which is in the form of a plush toy 10. Door stay 10 comprises a first part in the form of a left arm 11 and a second part in the form of a right arm 12, each arm being padded and extending to adjacent the door handle 13, 14. Arms 11, 12 are attached together. via a band or loop 15 (particularly illustrated in FIG. 4). FIG. 4A illustrates the attachment method to attach this version of the door stay to a door.

Figure 1:
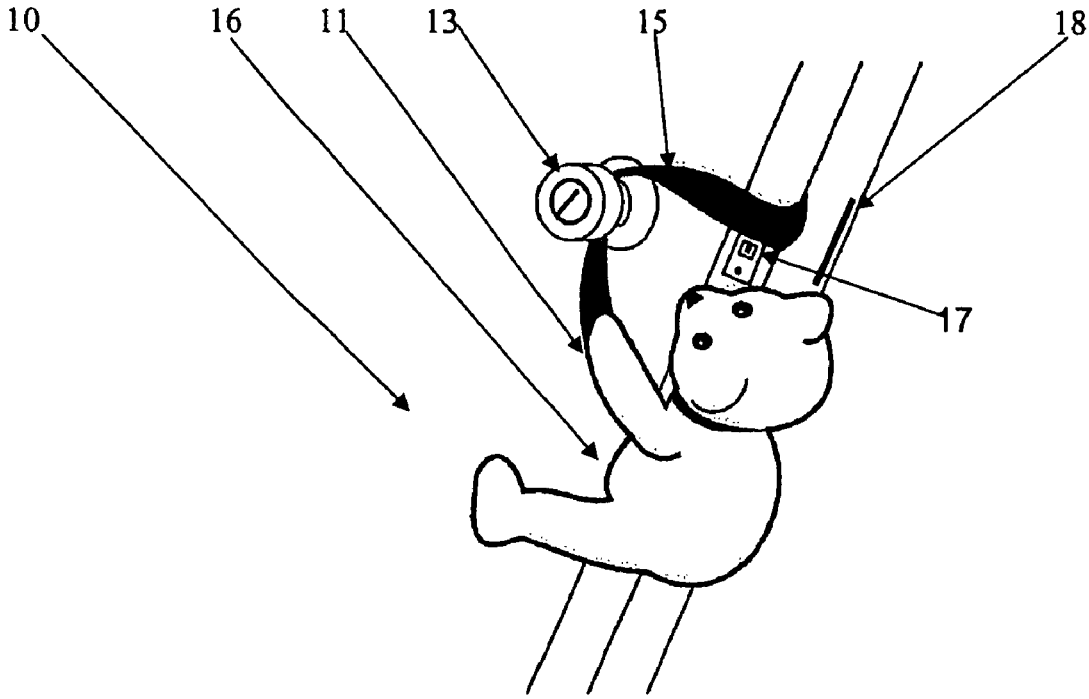
FIG. 1. Illustrates a door stay attached to a door and according to an embodiment of the invention.
Figure 2:
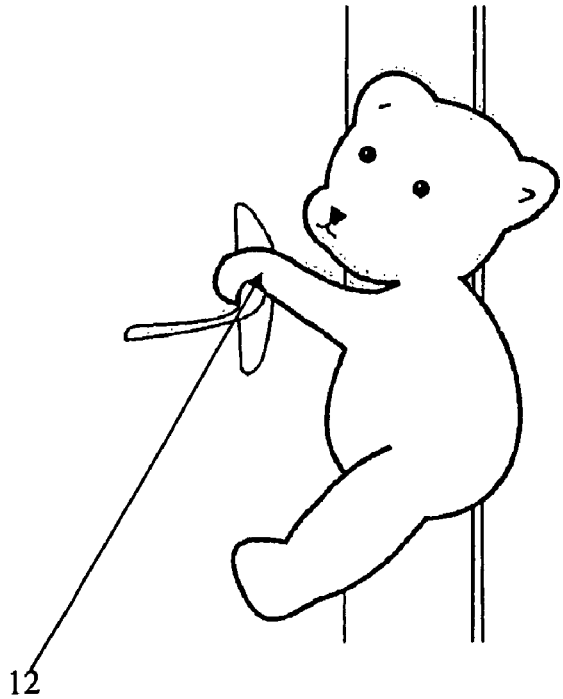
FIG. 2. Illustrates the door stay of FIG. 5, attached to a lever handled door.
Figure 3:
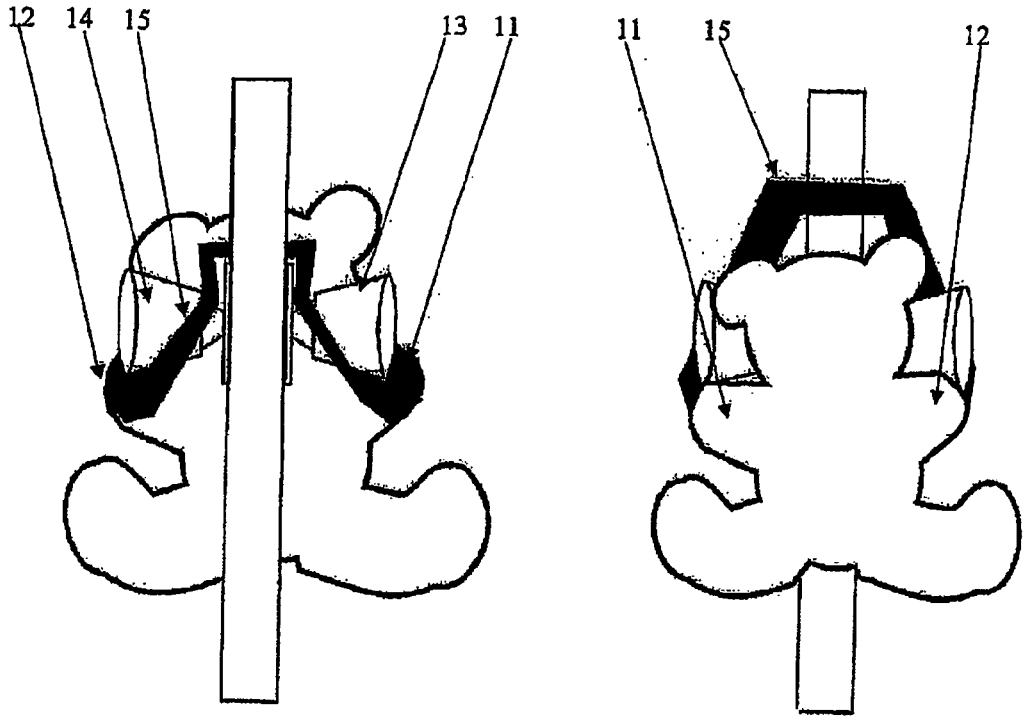
FIG. 3. Illustrates a front and rear view of a door stay where the first part and the second part are attached together to form a loop.

The door stay has an intermediate portion 16 which in the embodiment forms the body of the plush toy and which holds the door ajar sufficiently to prevent the latch tongue 17 (see FIG. 1) from engaging into the keeper 18 (again see FIG. 1). In the embodiment described in these figures, there may also be an advantage in having band 15 extend over latch tongue 17 to provide extra safety although this need not be essential.

The door stay, as well as having the two arm members 11, 12, preferably also has a pair of leg members 30, 31, with the leg members extending on each side of the door. These leg members (and the arm members) will keep the door stay in position.

Figure 5:
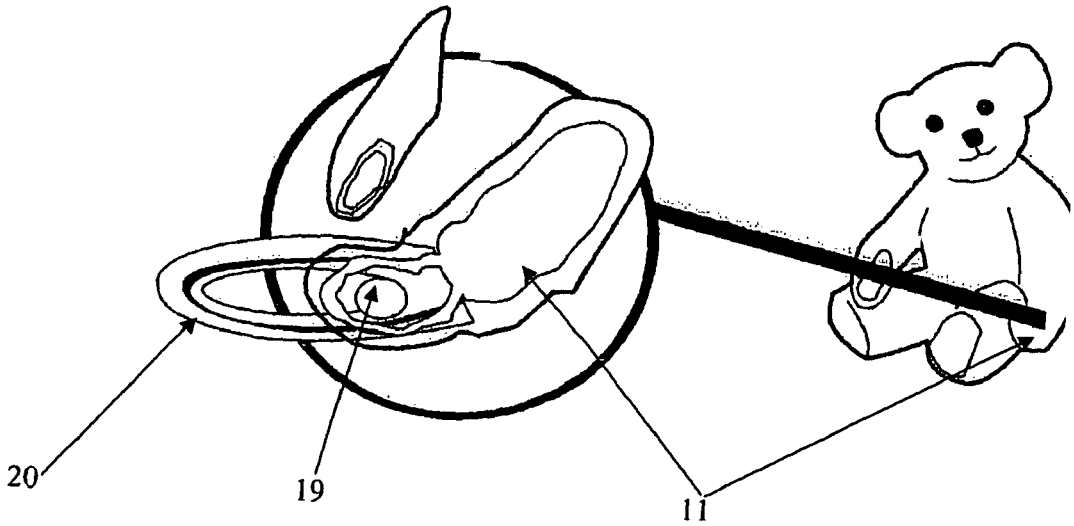
FIG. 5. Illustrates a variation of the door stay which uses an elastic band to attach the door stay to each door handle.

FIG. 5 illustrates a variation primarily to the way that the door stay is attached. In this variation, the end of the first part 11 and the second part 12 is formed with elastic banding 19 that can be stretched (see 20) to extend over the door knob. This variation of the invention will make it more difficult for the child to remove the door stay.

Figure 6:
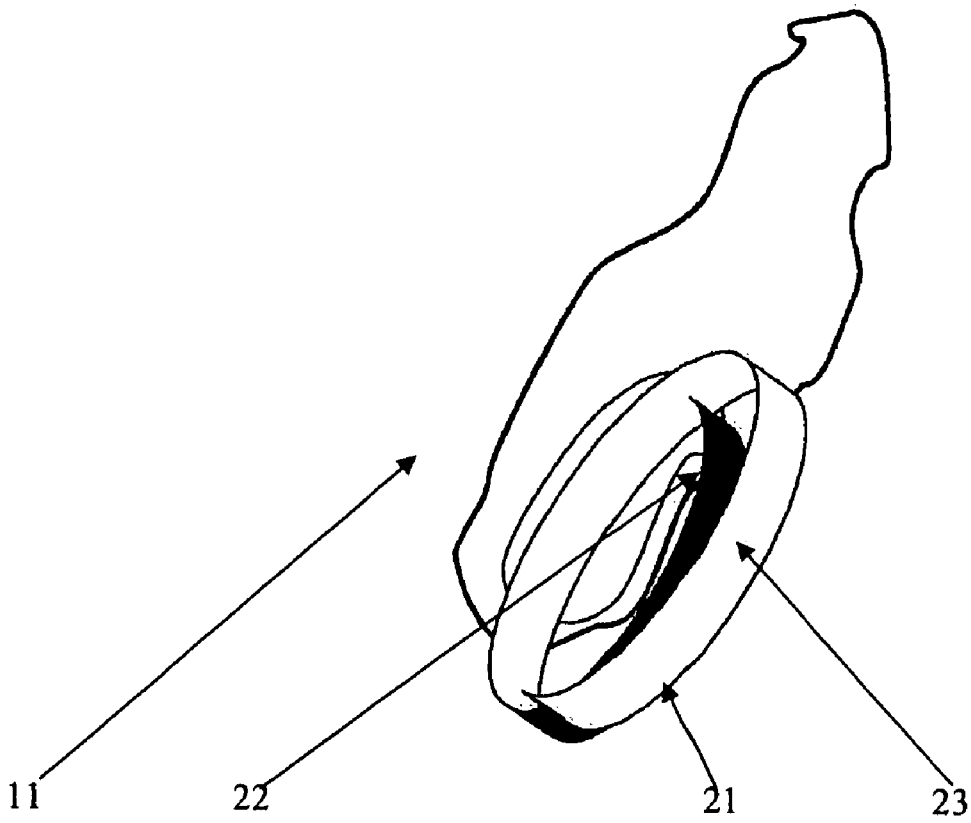
FIG. 6. Illustrates a variation to the door stay which uses Velcro to attach the door stay to each door handle.

FIG. 6 illustrates a variation where the end of the first part 11 and second part 12 contain a Velcro strap 21 that can be wrapped around the door knob and attached to itself. The Velcro strap contains the inner part 22 and the outer part 23 that can be attached to each other.

Figure 7:
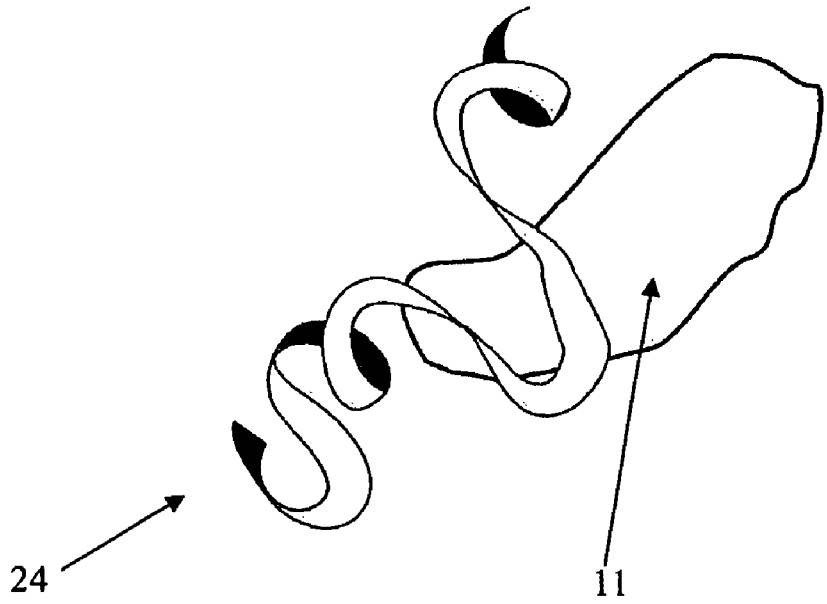
FIG. 7. Illustrates a variation to the door stay which uses a ribbon to attach the door stay to each door handle.

FIG. 7 illustrates a variation where a simple ribbon 24 is attached to the end of the first part 11 and the second part 12 and tied off against each handle.

Figure 8:
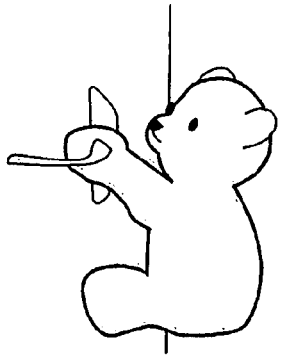
FIGS. 8-10. Illustrate a variation to the door stay where each arm member is provided with an elasticized opening that can fit over the door handle.
Figure 9:
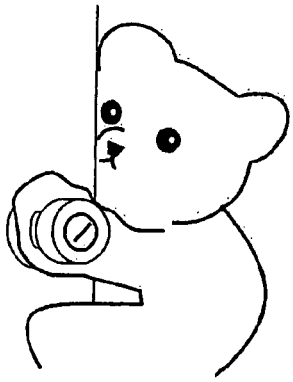
Figure 10:
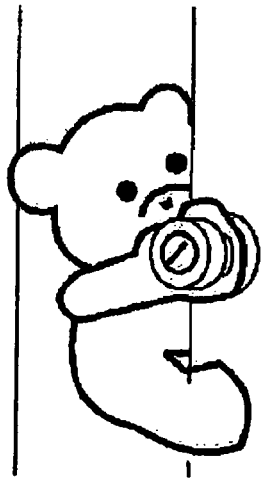

FIGS. 8-10 illustrates a variation where each arm member of the teddy bear is provided with an opening in the paw region, that can be fitted over a door handle that can be a lever handle or a knob handle. The opening can be elasticized to enable the opening to the enlarged to fit over the knob type handle and then to return back to the original size to provide a snug fit.

The door stay according to the invention provides many advantages. Firstly, a breeze can flow through the bedroom by having the door slightly ajar. There is little or no possibility of the door inadvertently slamming shut. There is little or no possibility of a child's fingers getting caught in a closing door. A parent can easily open the door silently (without needing to remove wedges etc.) to check on the baby without any disturbance or noise. The child feels more secure by not being entirely closed in a room. In the case of a fire, the door can be quickly opened and any pressure differential caused by the fire will be minimised by preventing the door from being latched. The stay will attach easily to any type of door knob and there is no need to worry about a floor tripping hazard etc. If it is desired to close the door, this can be easily achieved by removing one arm from one of the door knobs. If the stay is in the form of a plush toy, this is safe for the child to play with and can provide comfort and security to a child in the room (especially if the child plays with the door stay and bonds with it). By having the stay at door knob height, it is more difficult for a child to remove the stay compared with a roll of a towel etc. on the floor.

Throughout the specification and the claims (if present), unless the context requires otherwise, the term "comprise", or variations such as "comprises" or "comprising", will be understood to apply the inclusion of the stated integer or group of integers but not the exclusion of any other integer or group of integers.

Throughout the specification and claims (if present), unless the context requires otherwise, the term "substantially" or "about" will be understood to not be limited to the value for the range qualified by the terms.

It should be appreciated that various other changes and modifications can be made to any embodiment described without departing from the spirit and scope of the invention.

The invention claimed is:

1. A door stay for a door having a handle on each side of the door, the door being associated with a door frame, and wherein the door is contained within the door frame when the door is closed, the door stay comprising a toy including a first arm member, a second arm member, and a body intermediate said first arm member and said second arm member, said first arm member adapted to be supported by a door handle on one side of the door, said second arm member adapted to be supported by a door handle on the other side of the door, a band member joining said first arm member and said second arm member together so that said body is adapted to extend over an edge of the door, wherein said body is of sufficient thickness such that the pivoting movement of the door is restricted by the door stay, the thickness of said body precluding the door from closing to a point at which the door is contained within the door frame.

2. The door stay as claimed in claim 1, wherein the door has a latch tongue and the stay prevents the latch tongue from entering into a keeper on the door frame.

3. The door stay as claimed in claim 1, wherein said toy is a plush toy, and said band is elastic.

* * * * *